US006138282A

United States Patent [19]

Follese

[11] Patent Number: 6,138,282

[45] Date of Patent: Oct. 31, 2000

[54] UNDERPANTS WITH VERTICALLY WIDE, FOLD-DOWN WAISTBAND

[76] Inventor: Robert D. Follese, 3951 NW. 4th Ct., Ft. Lauderdale, Fla. 33066

[21] Appl. No.: 09/431,629

[22] Filed: Nov. 2, 1999

[51] Int. Cl.[7] ..... A41D 1/00

[52] U.S. Cl. ..... 2/400; 2/237; 2/220; 2/221; 2/236; 2/69; 2/227; 2/228

[58] Field of Search ..... 2/400–408, 227, 2/228, 238, 69, 236, 237, 220, 221

[56] References Cited

U.S. PATENT DOCUMENTS

D. 306,090 2/1990 Burneka ..... 2/228 X
D. 341,243 11/1993 Costella et al. ..... 2/238 X
4,642,818 2/1987 Dehnert et al. .
5,050,244 9/1991 Kleinman .
5,131,100 7/1992 Atwater et al. .
5,606,748 3/1997 Fujiwara .
5,675,842 10/1997 Schaefer .
5,704,071 1/1998 Barclay et al. .

*Primary Examiner*—Gloria M. Hale
*Attorney, Agent, or Firm*—Oltman, Flynn & Kubler

[57] ABSTRACT

Underpants having a vertically wide waistband that may be folded down over the waistband of an outer garment for the lower torso and legs (e.g., pants or skirt) to display in a right-side-up position markings on what would be the inside face of the underpants waistband if it were not folded down.

3 Claims, 1 Drawing Sheet

UNDERPANTS WITH VERTICALLY WIDE, FOLD-DOWN WAISTBAND

BACKGROUND OF THE INVENTION

This invention relates to underpants having a vertically enlarged waistband, part of which can be folded down outside the waistband of the outer garment (e.g., pants, jeans, shorts or skirt) to display markings, such as an advertisement.

It has become fashionable among some people to wear underpants with the top portion exposed above the waistband of the outer garment for the lower torso and legs (e.g., pants or skirt). It the outer garment is worn with its waistband at a conventional position on the person's body, this fashion innovation requires the wearer to raise the underpants to a position that may well cause discomfort. In addition, in the case of one style of knit underpants for men, if raised enough to be exposed above the waistband of the outer garment the underpants may be so tight on the wearer as to possibly cause a reduction in the sperm count.

The present invention addresses the problem of provided the desired underpants exposure without subjecting the wearer to discomfort or related problems by providing a waistband with a enlarged vertical width that enables it to be readily folded down over the outside of the outer garment so as to be visible there without requiring the wearer to raise the underpants beyond the normal position preferred by the wearer.

In the prior art, garments with special, wider than usual waistbands had them for different purposes entirely, and therefore would teach nothing toward the solution of the problems addressed by the present invention.

In U.S. Pat. No. 5,675,842 to Schaefer, a pair of outer pants has two waistbands, the inner one of which may either be tucked down out of sight or raised to an exposed position projecting above the top edge of the outer waistband.

In Kleinman U.S. Pat. No. 5,050,244, a pair of firefighter's trousers has a waist section that can project several inches above the belt line for body support when the wearer is actively engaged, or can be folded down outside the belt tunnel on the trousers for more comfort during a "cool down" period.

In Atwater et al U.S. Pat. No. 5,131,100, a wide, tight-fitting, elastic waistband on a set of man's athletic undershorts provides compressive support for the abdomen, a purpose that would be substantially negated if the waistband were folded down over the outside of the outer garment.

BRIEF SUMMARY OF THE INVENTION

In accordance with the present invention, a set of underpants of any style, woven or knit, male or female, is provided with a vertically wide waistband, the upper part of which can be folded down over the outside of the waistband of the outer garment for the lower torso and legs, whether pants-type or skirt-type. The large vertical size of the underpants waistband insures that it will say in place folded over while the underpants remain in a comfortable position on the wearer. Preferably, the underpants waistband carries a printed legend that is positioned right-side-up and exposed to view when the underpants waistband is folded down over the top portion of the outer garment.

Further objects and advantages of this invention will be apparent from the following detailed description of a presently-preferred embodiment thereof, shown in the accompanying drawings.

DETAILED DESCRIPTION OF THE PRESENT INVENTION

Before explaining the disclosed embodiment of the present invention in detail it is to be understood that the invention is not limited in its application to the particular arrangement shown and described since the invention is capable of other embodiments. Also, the terminology used herein is for the purpose of description and not of limitation.

Figure 1:
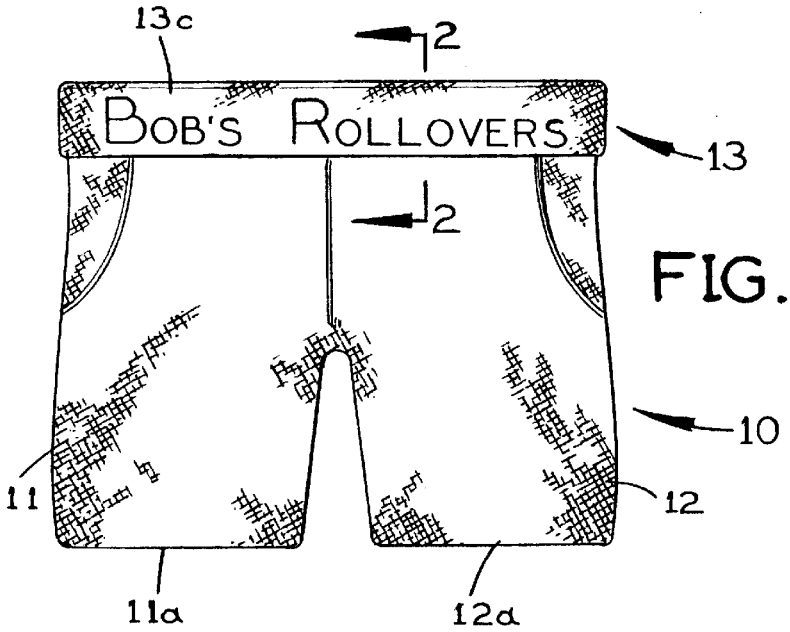
FIG. 1 is a front elevational view of a pair of shorts on the outside of underpants in accordance with the present invention, with the underpants waistband folded down over the top portion of the shorts.

FIG. 1 shows a conventional outer garment in the form of shorts 10 having individual legs 11 and 12 with openings 11*a* and 12*a* at the bottom for passing the wearer's respective legs. A set of underpants in accordance with the present invention is worn inside this outer garment in the usual way (and thus are not visible in FIG. 1) except that the waistband of the underpants is folded down over the waistband of the outer garment 10 and is visible there, as shown at 13 in FIG. 1.

Figure 2:
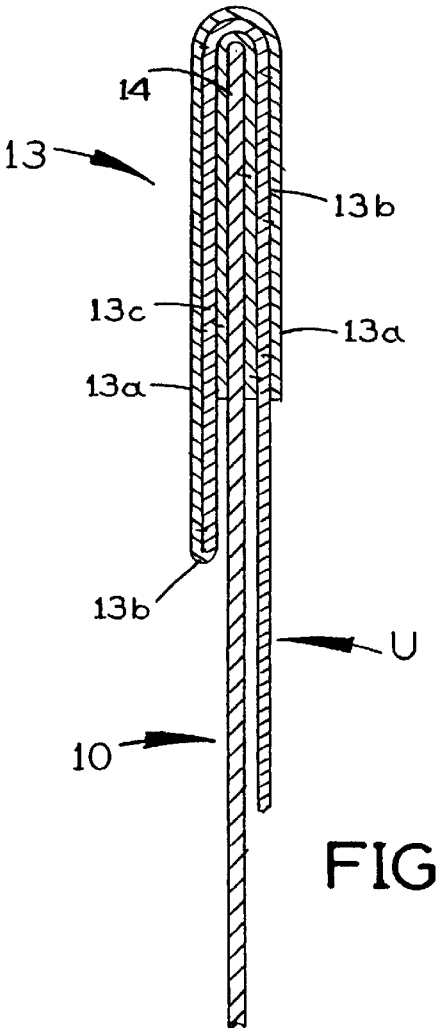
FIG. 2 is a vertical section taken along the line 2—2 in FIG. 1.
Figure 3:
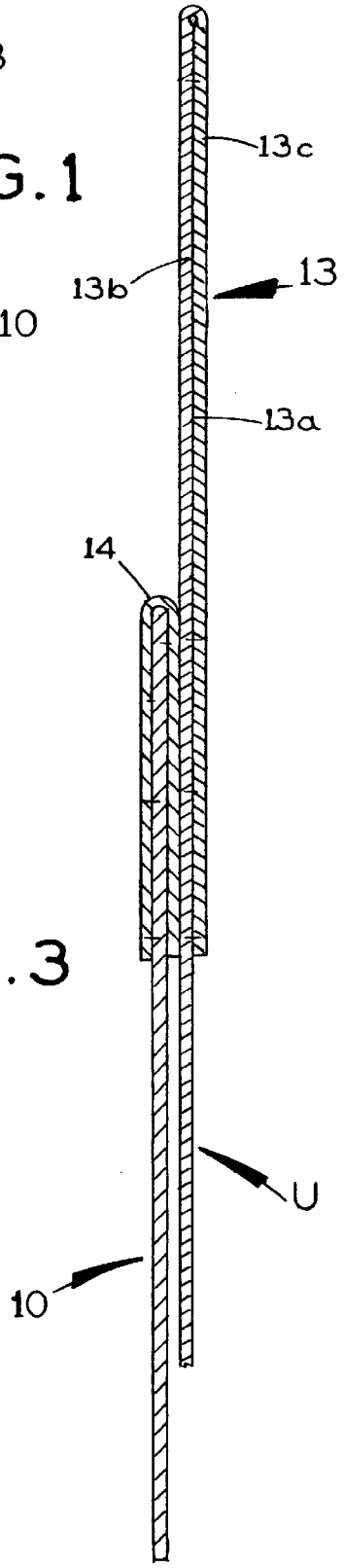
FIG. 3 is a view similar to FIG. 2 and showing the underpants waistband before being folded down over the waistband of the shorts or other outer garment.

FIG. 2 shows the upper part of the outer garment 10 and the underpants of the present invention in vertical section. The outer garment has the usual thickened waistband produced by several overlapped layers or plies of fabric stitched or otherwise bonded to each other, shown schematically at 14. The set of underpants U also has a thickened waistband with two or more overlapped plies of fabric, here shown as two plies 13*a* and 13*b* stitched together to form the waistband shown at 13 in FIG. 1. The underpants waistband 13 preferably is elastic to snugly engage the wearer's body, but it may be inelastic, if desired.

In accordance with this invention, the underpants waistband 13 has a vertical width substantially greater than is usual in underpants of conventional design—preferably, three inches or more. Because of this novel construction the underpants waistband can be readily folded down over itself, so that part of it (preferably, half or more) extends down across the top portion of the outer garment 10 at the latter's waistband 14. Thus, the waistband 14 of outer garment 10 is sandwiched inside the folded-over underpants waistband 13. The relatively large vertical width of the underpants waistband 13 enables it to stay in place in this folded-over position for as long as the wearer wants to have the underpants waistband exposed just above the waistline of the outer garment.

What is normally the inner face 13*c* of the underpants waistband becomes the exposed outer face of its folded-over segment on the outside of the outer garment 10, as shown in FIGS. 1 and 2. Preferably, this exposed face 13*c* of the underpants waistband carries alphanumeric symbols or other indicia, or special artistic or other markings, that are visible in a right-side-up position (i.e., not inverted) when the underpants waistband 13 is folded down over the outside of the outer garment waistband 14, as shown in FIGS. 1 and 2. For example, in FIG. 1 these symbols spell out the advertising message "Bob's Rollovers." This feature makes the present underpants particularly attractive to the sort of person who wants to "make a statement" by wearing the top of his or her underpants exposed to view. The enlarged vertical size of the waistband 13 insures that the present underpants can be worn comfortably in the usual position on the body since it is this enlarged vertical dimension that facilitates the desired exposure of part, there being no necessity to raise the underpants to a possibly uncomfortable position on the wearer's body for such exposure, as is the situation when conventional underpants are worn with the top exposed.

I claim:

1. Underpants to be worn under an outer garment for the lower torso and legs of a person, which outer garment has a waistline at the top, said underpants having a waistband constructed and arranged to be folded down on itself over the waistline of the outer garment for exposure outside the top portion of the outer garment, wherein said waistband carries indicia markings which are exposed to view in a right-side-up position when said waistband is folded down on itself over the waistline of the outer garment.

2. Underpants according to claim 1, wherein said waistband has a vertical width of at least three inches.

3. A set of underpants to be worn under a pants-like or skirt-like outer garment having a waistline, said set of underpants having a vertically enlarged waistband of sufficient vertical width enabling it to be folded down over an outside of the outer garment at the waistline, said underpants waistband having markings that are positioned right-side-up and exposed to view when said underpants waistband is folded down over the outer garment.

* * * * *